US007793598B2

(12) United States Patent
Strobl, Jr. et al.

(10) Patent No.: US 7,793,598 B2
(45) Date of Patent: Sep. 14, 2010

(54) PLASTIC PANEL, PARTICULARLY FOR USE AS PRODUCTION PALLET

(76) Inventors: Frederick P. Strobl, Jr., 204 N. Shore Dr., Cary, IL (US) 60013; Bradley D. LeGare, 37W667 Grey Barn Rd., St. Charles, IL (US) 60175

( * ) Notice: Subject to any disclaimer, the term of this patent is extended or adjusted under 35 U.S.C. 154(b) by 874 days.

(21) Appl. No.: 11/698,543

(22) Filed: Jan. 26, 2007

(65) Prior Publication Data

US 2008/0178775 A1 Jul. 31, 2008

(51) Int. Cl.
*B65D 19/06* (2006.01)
*B65D 19/18* (2006.01)
*E04C 2/34* (2006.01)

(52) U.S. Cl. ..... 108/57.26; 108/51.11; 108/901; 52/709.1; 52/793.11

(58) Field of Classification Search ..... 52/783.1, 52/783.14, 790.1, 793.11, 796.1, 630; 108/51.11, 108/57.25, 57.26, 57.17, 901, 902
See application file for complete search history.

(56) References Cited

U.S. PATENT DOCUMENTS

| | | | | | |
|---|---|---|---|---|---|
| 161,746 | A | * | 4/1875 | Brcok | 428/106 |
| 759,899 | A | * | 5/1904 | Lynch | 52/783.17 |
| 837,661 | A | * | 12/1906 | Bolton | 52/783.1 |
| 2,618,019 | A | * | 11/1952 | Orsini | 264/77 |
| 3,191,724 | A | * | 6/1965 | De Ridder | 52/570 |
| 3,222,697 | A | * | 12/1965 | Scheermesser | 428/160 |
| 3,260,027 | A | * | 7/1966 | Page et al. | 52/602 |
| 3,438,164 | A | * | 4/1969 | Duepree | 312/111 |
| 3,603,272 | A | * | 9/1971 | Ditges | 108/57.28 |
| 3,998,457 | A | * | 12/1976 | Dempsey et al. | 473/535 |
| 4,051,787 | A | * | 10/1977 | Nishitani et al. | 108/55.3 |
| 4,085,728 | A | * | 4/1978 | Tomchak | 126/669 |
| 4,189,125 | A | * | 2/1980 | Little | 248/346.02 |
| 4,220,100 | A | * | 9/1980 | Palomo et al. | 108/57.26 |
| 4,597,338 | A | * | 7/1986 | Kreeger | 108/57.26 |
| 4,742,916 | A | * | 5/1988 | Galea | 206/586 |
| 4,843,781 | A | * | 7/1989 | Chase, III | 52/792.11 |
| 5,102,703 | A | * | 4/1992 | Colonel et al. | 428/33 |
| 5,149,575 | A | * | 9/1992 | Soifer | 428/188 |
| 5,322,257 | A | * | 6/1994 | Verderose et al. | 248/345.1 |
| 5,497,709 | A | * | 3/1996 | Gonzalez et al. | 108/56.3 |
| 5,505,141 | A | * | 4/1996 | Barber | 108/57.26 |
| 5,568,994 | A | | 10/1996 | Dawson | |
| 5,685,233 | A | * | 11/1997 | DeJean | 108/57.17 |

(Continued)

*Primary Examiner*—Robert J Canfield
(74) *Attorney, Agent, or Firm*—Stinson Morrison Hecker LLP

(57) ABSTRACT

A plastic panel which may be used as a production pallet in the production of unitary concrete masonry products includes first and second joinable portions. The portions each comprise a support backing including an outer surface and an inner face, and a plurality of ribs extending outwardly away from said inner face. The ribs of a first grouping thereof are parallel with one another and extend across a first area of the face in a first direction, and the ribs of a second grouping thereof extend across a second area of the face in a second direction which is not parallel with said first direction. The panel portions are configured, disposed and arranged so as to join with one another in generally overlapping and mated relationship with the outer surfaces disposed in spaced apart opposing relationship, with the first groupings of ribs of the respective portions disposed in intermeshing and mating relationship with each other, and with the second groupings of ribs of the respective portions also disposed in intermeshing and mating relationship with each other whereby to present said plastic panel.

6 Claims, 13 Drawing Sheets

U.S. PATENT DOCUMENTS 5,794,544 A * 8/1998 Shuert ..... 108/57.25
5,967,056 A * 10/1999 Plante ..... 108/56.1
6,036,155 A * 3/2000 Tsui ..... 248/345.1
6,044,601 A * 4/2000 Chmela et al. ..... 52/287.1
6,142,713 A 11/2000 Woolford et al.
6,167,817 B1 * 1/2001 Liu ..... 108/51.11
6,317,945 B1 * 11/2001 Laphan et al. ..... 27/10
6,352,039 B1 * 3/2002 Woods et al. ..... 108/57.25
6,357,366 B1 * 3/2002 Frankenberg ..... 108/57.25
6,805,061 B2 * 10/2004 Smyers et al. ..... 108/57.25
7,048,472 B2 5/2006 Woolford et al.
7,090,911 B2 * 8/2006 Lascelles ..... 428/163
2007/0062420 A1 * 3/2007 Apps et al. ..... 108/57.25
2008/0066658 A1 * 3/2008 Muirhead ..... 108/57.29

* cited by examiner

PLASTIC PANEL, PARTICULARLY FOR USE AS PRODUCTION PALLET

CROSS REFERENCE TO RELATED APPLICATION

None

BACKGROUND OF THE INVENTION

1. Field of the Invention

The present invention relates to plastic panels (or slabs) and particularly to such items for use as production boards and/or pallets and the like. Even more particularly the invention relates to production boards or pallets useful in the production of unitary concrete masonry products such as paving stones and the like.

2. The Prior Art Background

Concrete masonry units such as paving stones and the like are produced in manufacturing facilities where the paving stones are cast and cured and eventually stored. The production operations include, inter alia, molding, compacting, vibrating, heating in high humidity, washing, brushing, cleaning, stacking, etc. Traditionally the stones are carried on a production pallet during the various production operations. Such pallets are thus exposed to the same set of conditions as the stones undergoing production. In addition, the pallets are subject to additional wear and tear because they must be handled by automated devices such as stackers conveyors and/or by human operated machines such as fork lifts. Finally after the concrete products are unloaded the pallets must be cleaned and stacked for reuse. Prior art patents describing the production of paving stones and the like include U.S. Pat. No. 6,142,713 to Woolford, et al., U.S. Pat. No. 7,048,472 to Woolford, et al. and U.S. Pat. No. 5,568,994 to Dawson.

In the past there have been a variety of types of boards and/or pallets used in the concrete products industry. For example, useable prior art boards have been fabricated from materials such as hard wood, steel, and synthetic thermoplastic materials. Pallets fabricated from hard wood or thermoplastic materials often require internal or external strengthening. Prior art pallets and boards have also been fabricated as composite structures including a wooden or plastic laminated core covered by a plastic outer layer.

Commercially it has been known that useful pallets and/or boards should be lightweight, sturdy, long-lasting, damage and wear resistant, dimensionally stable and rigid. In addition it has been known that such products sometimes wear out so as to no longer be useful. Therefore it is desirable for the same to be fabricated from recyclable materials such as synthetic thermoplastic materials. Accordingly it is well known that molded plastic panels may be used as production pallets in the concrete masonry unit.

Although it is well known to use molded plastic panels as production pallets in the concrete masonry unit industry, such use has not been without its shortcomings. Dimensional stability is highly desirable and yet it is difficult to fabricate a panel from a thermoplastic material without substantial warping and/or difficulty in filling the mold. Furthermore, where internal steel strengthening bars are utilized to provide strength and rigidity to the plastic panel, the reclamation of the thermoplastic material from worn out panels is hindered. To solve such problems, it is known to mold the panel as two separate halves to enhance the molding procedure. Such halves are then joined together so as to present a single panel. Additional labor and hardware or bonding agents or heat have been necessary in the past to join the halves and keep them from later parting and causing difficulties somewhere along their journey.

In sum, the concrete masonry unit industry in particular is continually in need of better and more commercially beneficial equipment to enhance, improve and facilitate the overall production process. In particular the concrete masonry unit industry is continually in need of improved, enhanced and less expensive equipment such as production boards and the like.

SUMMARY OF THE INVENTION

One of the primary objects of the invention is to provide an improved plastic panel which may be, but is not necessarily, used as a production board or pallet for supporting and transporting concrete masonry units during the fabrication of the latter. In particular the invention provides a novel configuration for the separate halves of a plastic panel, which configuration facilitates molding, strengthening, joinder and maintaining the joined halves together to present the complete panel.

In one preferred form the invention provides a plastic panel comprising first and second joinable portions. These portions each desirably comprise a support backing including an outer surface and an inner face and a plurality of ribs extending outwardly away from the inner face. The ribs of a first grouping thereof are disposed to extend across a first area of the face in a first direction in general parallelism relative to one another, and the ribs of a second grouping thereof are disposed to extend across a second area of the face in a second direction which is not parallel with the first direction. The portions are configured, disposed and arranged so as to join with one another in generally overlapping and mated relationship with the outer surfaces thereof disposed in spaced apart opposing relationship, with the first groupings of ribs of the first and second portions disposed in intermeshing and mating relationship with each other, and with the second groupings of ribs of the first and second portions disposed in intermeshing and mating relationship with each other whereby to present the plastic panel. Ideally for manufacturing and assembly efficiency, the portions may by identical.

Preferably, the first grouping of ribs and the second grouping of ribs of each portion are disposed at right angles relative to each other. Desirably the ribs of the first groupings extend across said faces for a greater distance than do the ribs of the second groupings. Ideally the ribs all extend away from said faces for essentially the same distance.

In a particularly preferred embodiment of the invention where strength is a factor, the portions may each include at least one reinforcing bar slot which is parallel to the ribs of the first grouping. Desirably such slots may be configured, arranged and positioned for alignment to present a reinforcing bar holding chamber when the portions are joined together.

In a particularly valuable commercial form, each portion may include two of the second groupings of ribs disposed on opposite sides of the first area of the face. In addition, each of the portions may include a peripheral wall which extends around the ribs. Ideally, the walls may have shoulders which are disposed in abutting relationship when the portions are joined together to form a panel.

DETAILED DESCRIPTION OF THE PREFERRED EMBODIMENTS

Figure 1:
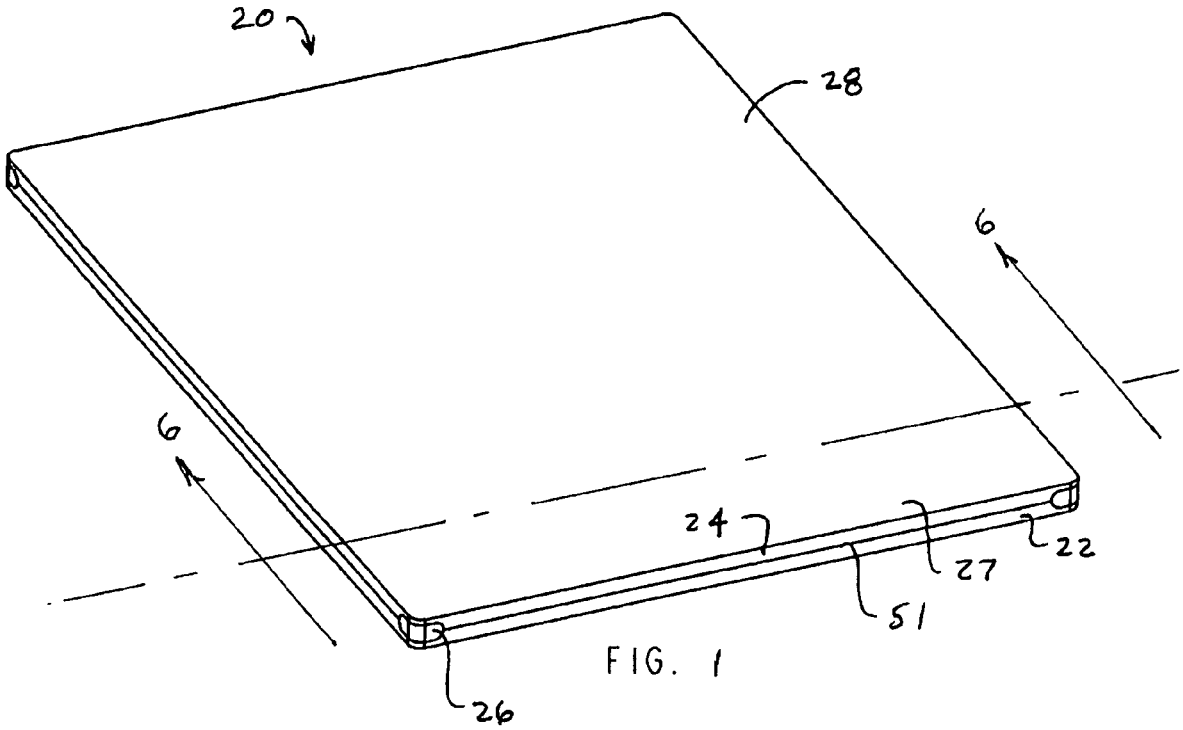
FIG. 1 is an isometric view of a preferred embodiment of a plastic panel in the form of a production pallet which embodies the concepts and principles of the invention.

A preferred embodiment of a plastic panel which embodies the concepts and principles of the invention is illustrated in FIG. 1 where the same is identified broadly by the reference numeral 20. The plastic panel 20 as illustrated in FIG. 1 is in a form having particular utility as a production board or pallet. In particular boards such as the board 20 have particular utility in the production of unitary concrete masonry products such as paving stones and the like. In use, the individual paving units are formed and carried by the board throughout the various unit processes involved in the production of the masonry products including molding, compacting, curing, etc.

Plastic panels useful as production pallets in the production of masonry products often come in standard sizes well known to those skilled in the art and may preferably be rectangular and may have outer dimensions which may be dependent upon the production facilities and may vary from about 2 ft×3 ft to about 4 ft×5 ft. Generally speaking the panels may desirably have a thickness of about 2 inches; however, once again the thickness may vary between production facilities.

With reference to FIG. 1, it can be seen that the board 20 includes a lower portion 22 and an upper portion 24. The words "upper" and "lower" are used here in a relative sense only and it will be apparent to those of ordinary skill in the art that portion 22 could be the upper portion and portion 24 could be the lower portion if the panel were to be turned over. In addition, in a preferred form of the invention, the board may include a corner bumper 26 at each of its four corners. The portions 22 and 24 desirably may be formed separately using any sort of thermoplastic molding material; however, the same ideally may be formed by injection molding from recycled plastic materials such as polyolefins or the like. Desirably, but not necessarily, the portions 22 and 24 may be identical as described hereinafter so as to provide efficiency and economy in the molding and assembly operations.

Figure 3:
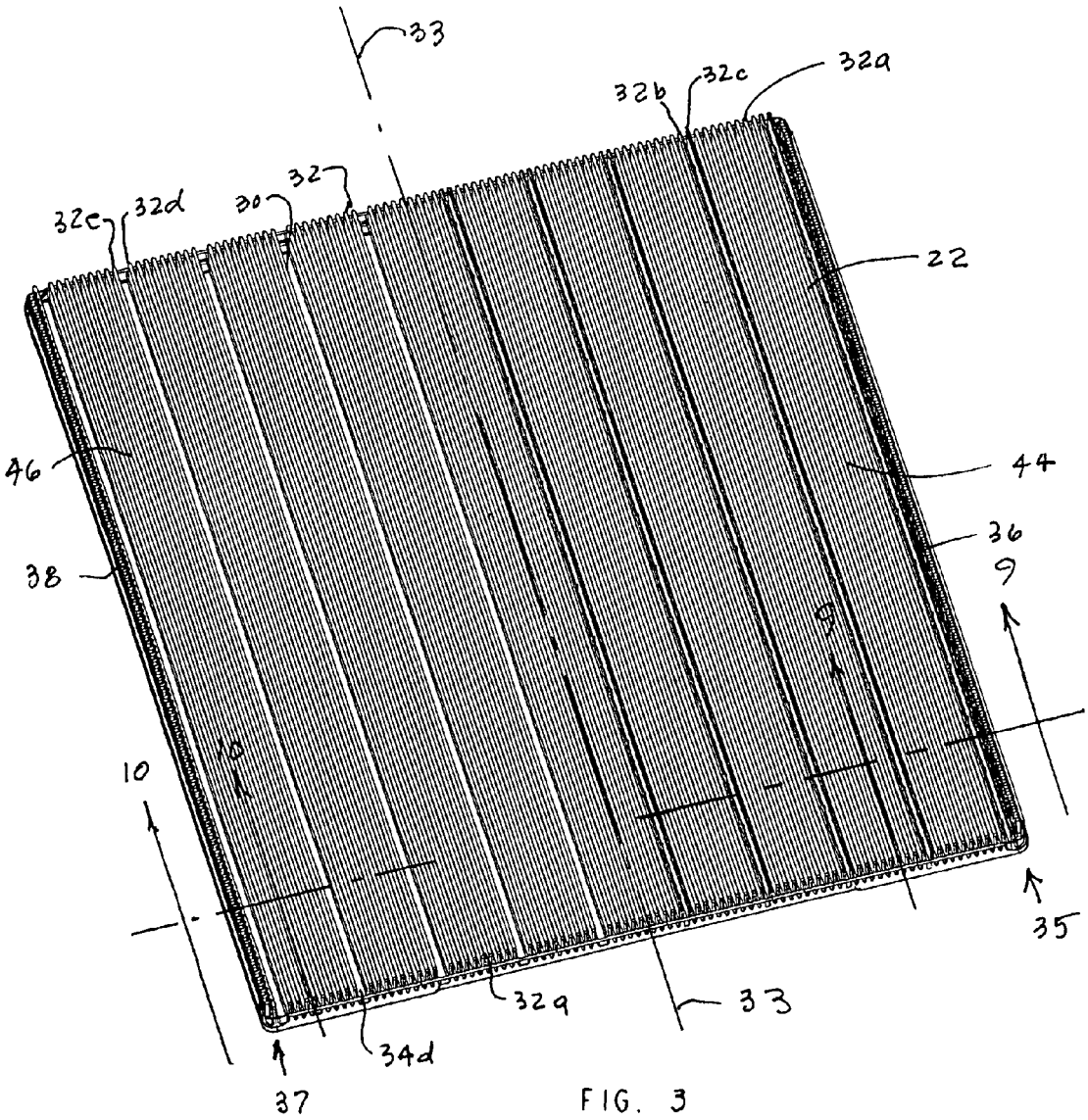
FIG. 3 is an angular view of one of the two portions of the panel of FIG. 1 which are joined together to present the whole panel.

As can be seen in FIG. 1, portion 24 has a support backing 27 including an outer surface 28. Similarly portion 22 has a support backing including an outer surface which cannot be seen in FIG. 1 because it is beneath the board 20. With reference to FIG. 3 it can be seen that support backing 27 also has an inner face 30 facing in the opposite direction from outer surface 28.

Figure 4:
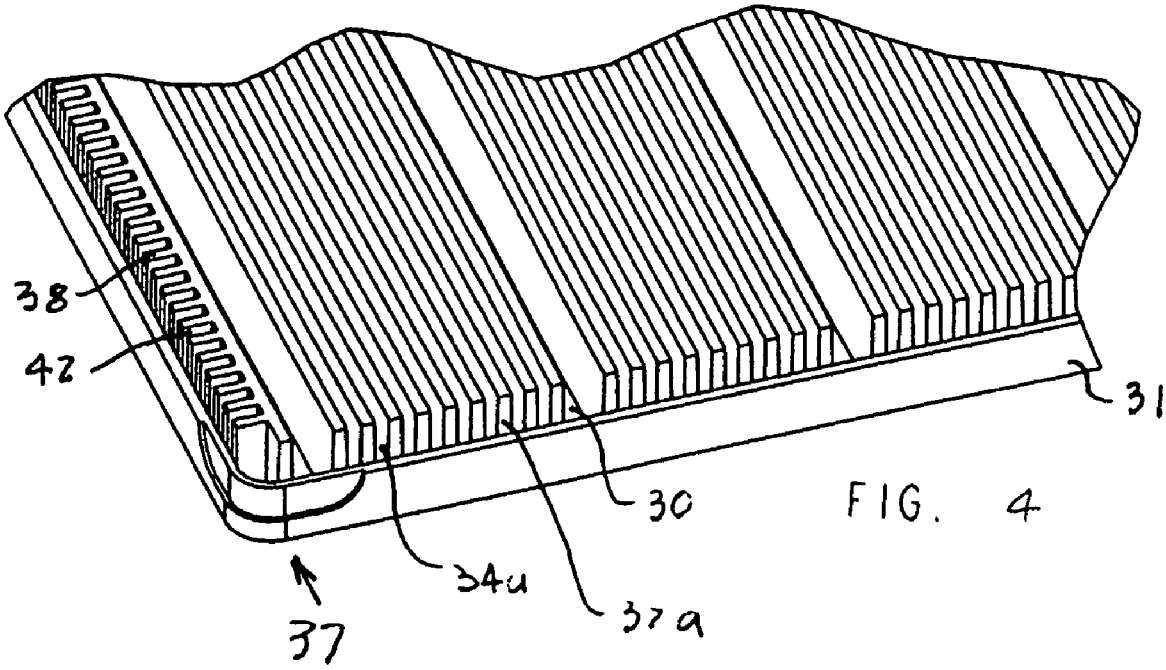
FIG. 4 is an enlarged fragmentary view of the lower left hand corner segment of the panel portion of FIG. 3.
Figure 5:
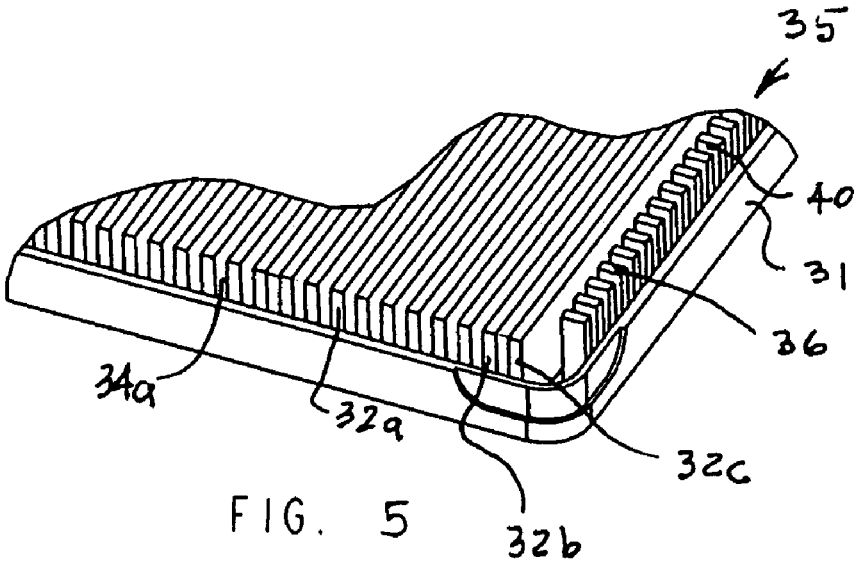
FIG. 5 is an enlarged fragmentary view of the lower right hand corner segment of the panel portion of FIG. 3.

Since the portions 22 and 24 are identical in the preferred embodiment shown in the drawings, only portion 22 will be described hereinafter. Portion 22 is illustrated in FIGS. 3, 4 and 5 where it can be seen that the same includes a plurality of elongated ribs 32 extending outwardly and upwardly away from inner face 30 and along the latter in a direction which is parallel to the major axis 33 of portion 22. A wall 31 is desirably included at the periphery of the inner face 30 to surround and enclose the ribs 32 as shown. The majority of the ribs 32*a* are essentially identical with one another and the same are spaced apart at regular generally equidistant intervals presenting essentially identical gaps 34*a* therebetween. However, several pairs of adjacent ribs 32*b* and 32*c* are different. These anomalous ribs 32*b*, 32*c* can be seen particularly in FIG. 9, where it can also be seen that the sides 32*a*' of the ribs 32*a* have a slight pitch from top to bottom for a purpose to be explained in detail hereinafter. Ribs 32*b* and 32*c*, present a gap 34*b* therebetween. The sides 32*b*' and 32*c*' of ribs 32*b* and 32*c* respectively, which face away from gap 34*b*, have a pitch that is essentially the same as the pitch of sides 32*a*' of ribs 32*a*. On the other hand, the sides 32*b*" and 32*c*", which face one another on opposite sides of the gap 34*b*, are not pitched but rather are essentially perpendicular relative to face 30. As can be seen with reference to FIG. 3, in the preferred embodiment illustrated in the drawings, portion 22 includes five pairs of ribs 32*b*, 32*c*. The purpose of these pairs of ribs 32*b*, 32*c* will be explained in greater detail hereinafter. Desirably, although not mandatory, the ribs 32 may be spaced apart at regular intervals of about 0.4375 inch from centerline to centerline and the wall 31 and the backing 27 may have respective thicknesses of approximately 0.1875 inch.

Figure 10:
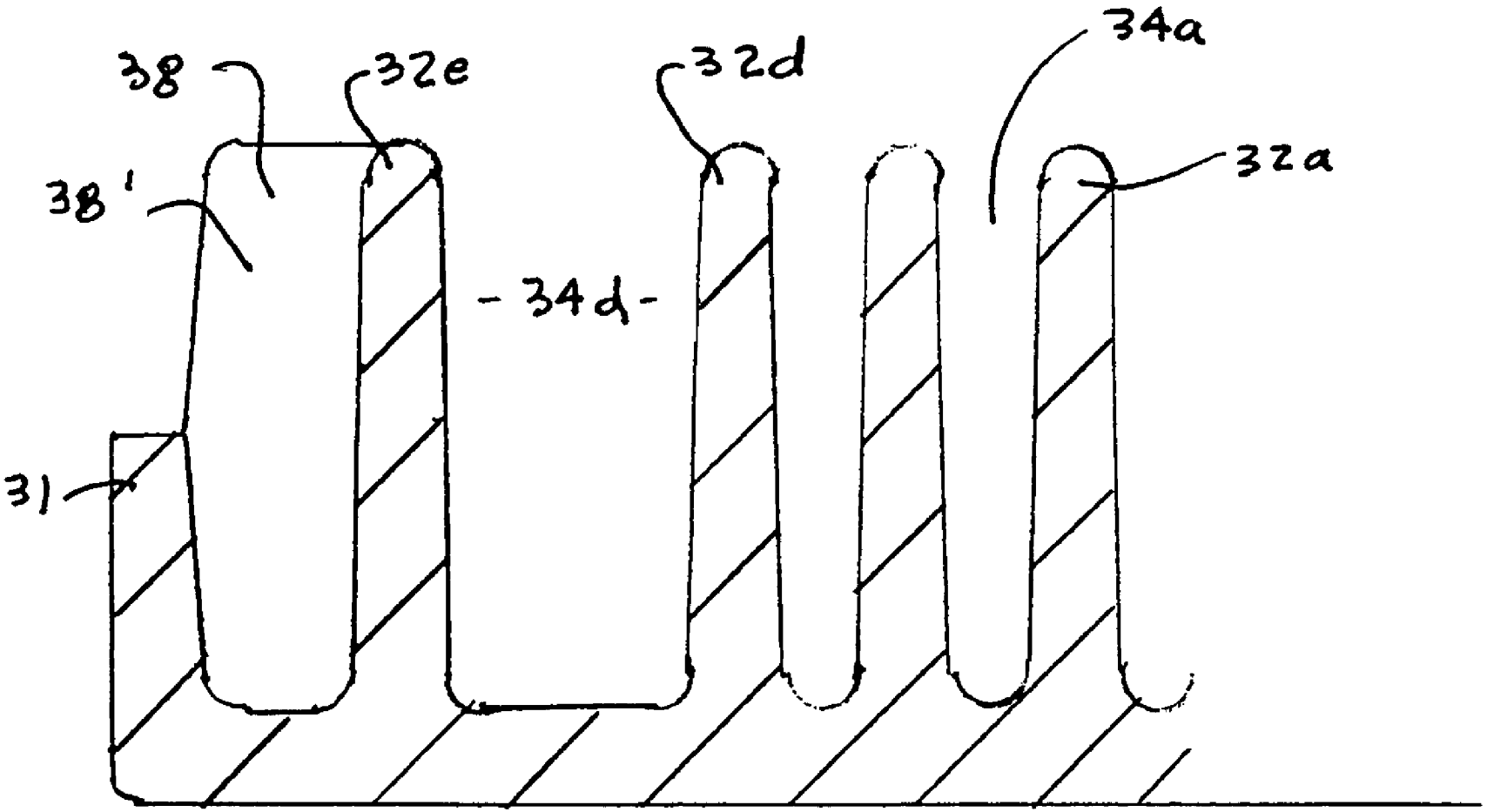
FIG. 10 is an enlarged, fragmentary cross-sectional view taken essentially along the line 10-10 of FIG. 3.

Portion 22 also includes ribs 32*d* and 32*e* which are spaced further apart than the ribs 32*a* so as to present a gap 34*d* therebetween which is approximately three times as wide as the gaps 34*a*. As can be seen with reference to FIG. 3, in the preferred embodiment illustrated in the drawings portion 22 includes five of the wider gaps 34*d*. The spatial characteristics of the wider gaps 34*d* relative to the gaps 34*a* is best illustrated in FIG. 10. Again, the purpose of these wider gaps 34*d* also will be explained in greater detail hereinafter.

In addition to the ribs 32 discussed above, portion 22 also includes a grouping 35 of shorter stub ribs 36 on the right hand side thereof as depicted in FIG. 3 and another grouping 37 of shorter stub ribs 38 on the left hand side thereof as depicted in FIG. 3. However, if the portion 22 were viewed from the far end in FIG. 3, the right and left positioning of the groupings 35, 37 would be reversed. These shorter stub ribs may be seen in greater detail in FIGS. 4, 5, 12 and 13. Although the stub ribs 36, 38 are shown only schematically in the drawings, it is to be understood that the same are essentially identical in transverse cross-sectional configuration to the ribs 32*a* such that gaps 40 are presented between the ribs 36 and gaps 42 are presented between the ribs 38. Moreover, the ribs 36, 38 have pitched sides 36', 38' which are of essentially the same shape as the pitched sides 32*a'* of the ribs 32*a*.

Figure 9:
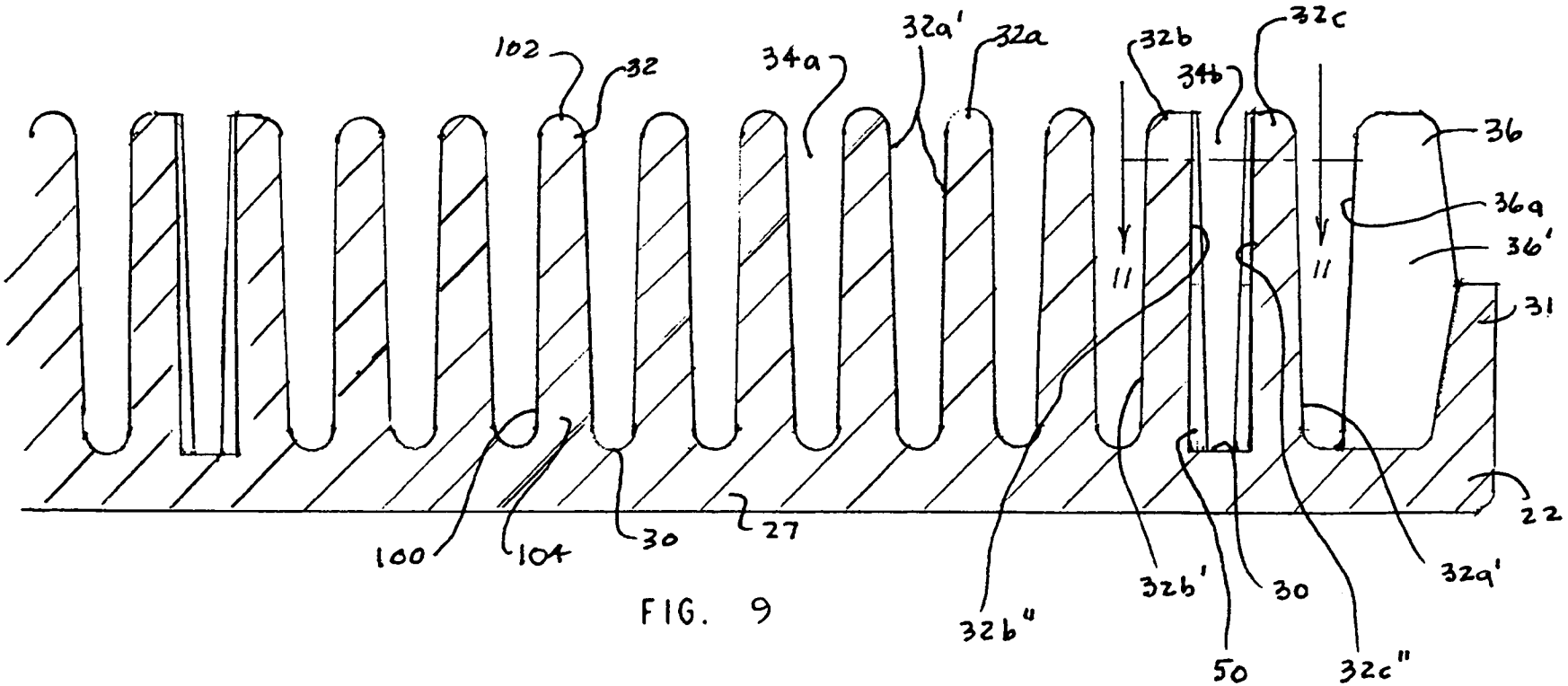
FIG. 9 is an enlarged, fragmentary cross-sectional view taken essentially along the line 9-9 of FIG. 3.
Figure 13:
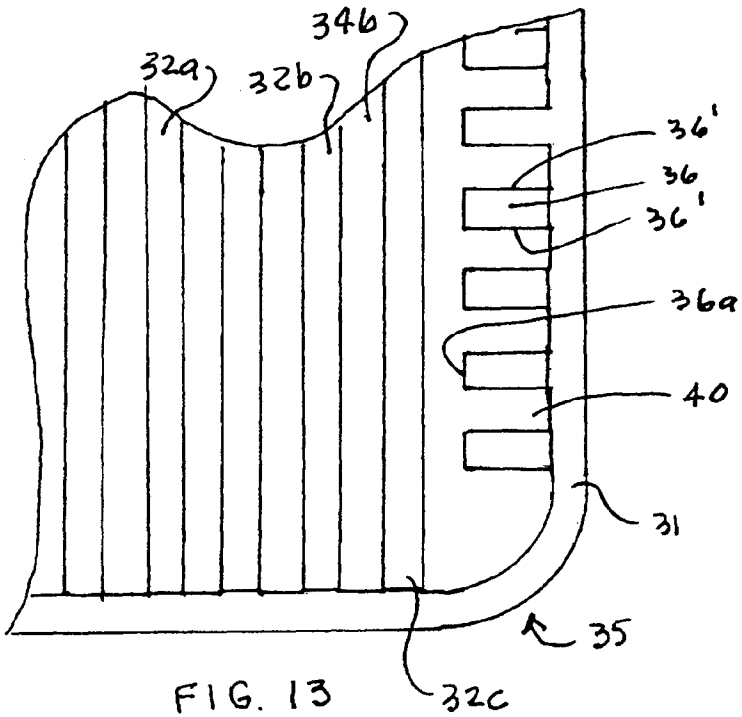
FIG. 13 is an enlarged, fragmentary plan view of the lower right hand corner segment of the panel portion shown in FIG. 3.
Figure 12:
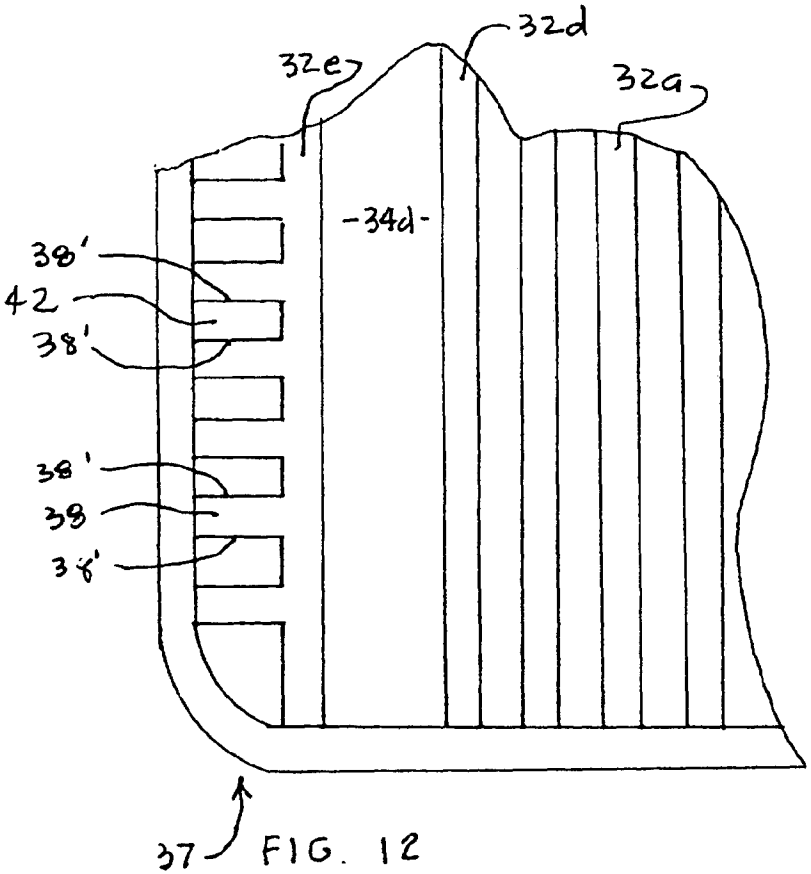
FIG. 12 is an enlarged, fragmentary plan view of the lower left hand corner segment of the panel portion shown in FIG. 3.

As can be seen viewing FIGS. 5, 9 and 13, the ribs 36 are essentially free standing and have interior sides 36*a* that are sloped at an angle that is essentially the same as the slope of the pitched sides 32*a'* of ribs 32*a*. On the other hand, as can be seen viewing FIGS. 4, 10 and 12, the ribs 38 are integral with the adjacent rib 32*e*. In accordance with the preferred form of the invention, the ribs 36, 38 are disposed generally perpendicularly to the ribs 32. However, as will be appreciated by those skilled in the art, the angle between the ribs 36, 38 on the one hand and the ribs 32 on the other does not necessarily need to be 90 degrees. Moreover, it will also be appreciated by those skilled in the art that it is not necessary, in accordance with the invention, for the panel portion 22 to include two groupings 35, 37 of angularly disposed ribs 36, 38, nor to place the same at the outer edges of the main grouping of ribs 32. Finally, it is not necessary that the sets of ribs be of different lengths. That is to say, the ribs 36, 38 of the angularly disposed groupings may just as well be of the same length as the ribs 32 to achieve the purposes of the invention.

With particular reference to FIG. 3, it is desirable for the panel portion 22 to include a first segment 44 and a second segment 46. As shown in FIG. 3, segment 44 is positioned to the right on portion 22 while segment 46 is positioned to the left. Again, if the portion 22 were viewed from the far end in FIG. 3, the right and left positioning of the segments 44, 46 would be reversed. Thus it is clear that the words "left" and "right" are also used here in a relative sense only. In any event, segment 44 desirably includes a plurality (5 as shown) of pairs of ribs 32*b*, 32*c* (shown with darker lines in FIG. 3), while segment 46 desirably includes a plurality (5 as shown) of the wider gaps 34*d*. Moreover, the pairs of ribs 32*b*, 32*c* are disposed at the same distance apart as are the gaps 34*d*. Needless to say, the grouping 35 of shorter ribs 36 is desirably located on the right hand edge of segment 44, whereas the grouping 37 of shorter ribs 38 is desirably located on the left hand edge of segment 46.

Figure 2:
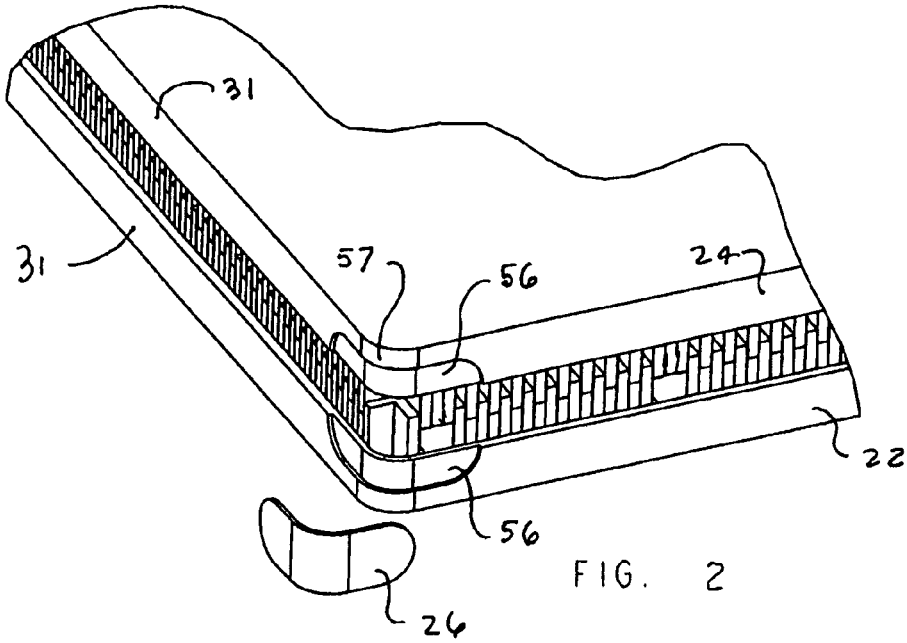
FIG. 2 is an enlarged partially exploded fragmentary view of the lower left hand corner segment of the panel of FIG. 1.

As mentioned above, the panel portions 22, 24 preferably are identical, and in accordance with the particularly preferred aspects of the invention, the panel portions 22, 24 may be joined together so as to form the panel 20 as shown in FIGS. 1, 2, 6, 7 and 8. To facilitate such joinder, the panel portions 22, 24 are configured, disposed and arranged so as to join with one another in generally overlapping and mated relationship with outer surfaces 28 thereof disposed in spaced apart opposing relationship, with the ribs 32 of the portions 22, 24 disposed in intermeshing and mating relationship with each other, and with the ribs 36 disposed in intermeshing and mating relationship with the ribs 38 whereby to present the plastic panel 20. These intermeshing and mating relationships may best be seen with reference to FIGS. 2, 6, 7 and 8. In this regard it is to be noted that in order for the panel portions of the preferred embodiment to properly mate, portion 22 will be placed in a position similar to that shown in FIG. 3, whereas panel 24 will be positioned above panel 22 in a disposition that is the same as the disposition panel 22 would assume if it were to be rotated 180 degrees in either direction around axis 33. Panel 24 may then be moved toward panel 22 while keeping panels 22, 24 in a generally parallel relationship as best illustrated in FIG. 2 so that the pairs of ribs 32*b*, 32*c* of each panel portion are received within a corresponding wider gap 34*d* of the other panel portion.

For added strength, steel bars 48 may desirably be placed in the gaps gap 34*b* between sides 32*b*" and 32*c*" of the ribs 32*b*, 32*c* before the two panel portions are joined. Desirably these bars 48 may have a width that is essentially coextensive with the height of the ribs 32*b*, 32*c*. Moreover, the bars 48 may have a thickness that is essentially the same as the width of gap 34*b*.

Figure 11:
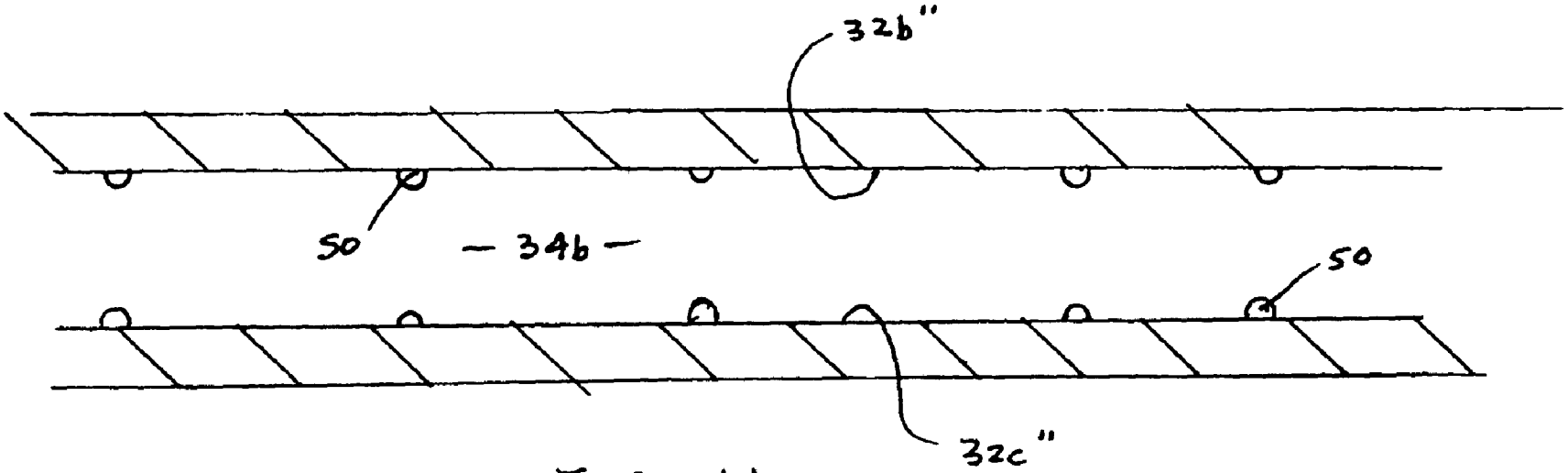
FIG. 11 is an enlarged, fragmentary cross-sectional view taken essentially along the line 11-11 of FIG. 9.

In a preferred form of the invention, the panel portions 22, 24 may also include small friction applying elements 50 that project outwardly from the sides 32*b*" and 32*c*" and into gap 34*b*, as particularly shown in FIGS. 9 and 11. These elements 50, which preferably, but not critically, may be generally semi-circular in transverse cross-sectional configuration and may desirably have a slight pitch (draft angle) of about 1 degree, impose additional friction on the bars 48 for holding the latter in position as the two portions 22, 24 are manipulated during the joinder thereof. Desirably these elements 50 may be arranged in opposing arrays as shown in FIG. 11. Further, the elements 50 may ideally extend upwardly from inner face 30 for essentially the entire height of sides 32*b*" and 32*c*", as the case may be, and desirably the same may all have a transverse cross-sectional configuration having a radius of approximately 0.03125 inch at the end nearest face 30, or just enough to clamp the bars 48 and prevent the latter from "waffling" during assembly and use of the panel 20.

As can be seen in the drawings (FIGS. 9 and 11), and as described above, the bars 48 are held in place by the elements 50 that project outwardly from the sides 32*g* and 32*c* and into gap 34*g*. The elements 50 are positioned and configured to firstly impose friction on bars 48 for holding the latter in position as the two portions 22, 24 are manipulated during joinder. Secondly, and perhaps more importantly, the elements 50 impose large lateral loads on bars 48 to prevent waffling of the latter when the portions 22, 24 are completely meshed together. Desirably the elements 50 are arranged in opposing arrays as shown in FIG. 11. Testing has shown that the bars 48 are more effective in strengthening the pallet against sagging during use if the bars 48 are prevented from waffling. The elements 50 provide anti-waffling support to the bars 48 in essentially the same way as the flanges of an I-beam prevent waffling of the central web of the beam. The key here is that pallet sag may be diminished or eliminated totally if the bars are prevented from moving laterally.

Figure 17:
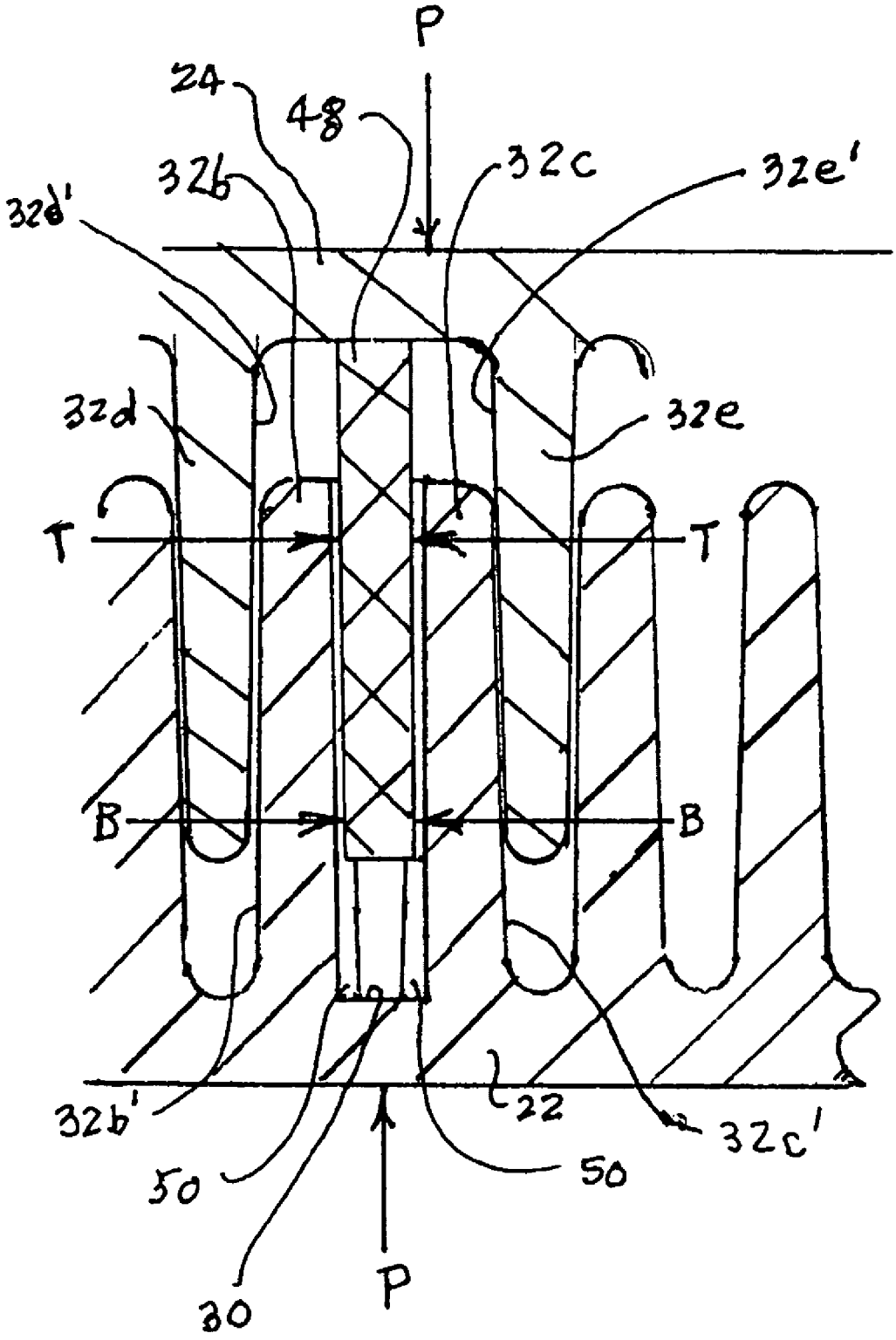
FIG. 17 is an enlarged schematic cross-sectional view illustrating the manner in which the panel portions are joined to form the panel.

During the first stage of the steel bar 48 installation procedure, the bar is held in place by friction imposed by the tapered elements 50. Bar 48 is tapped into place just enough to be held by elements 50 during further manipulation. During this tapping, ribs 32*g* and 32*c* will be forced apart. Accordingly, bar 48 is held in place by the forces imposed thereon by the spreading of ribs 32*g*, 32*c* resulting from the interaction of the bar 48 with the tapered elements 50. During the second stage of the steel bar 48 installation procedure, and with particular reference to FIG. 17, the tapered elements 50 load the bar laterally (at BB) as portions 22, 24 are pressed together. Further, because of the pitch and relative spacing of ribs 32*d* and 32*e* on the one hand and the ribs 32*g* and 32*c* on the other hand, a lateral load TT is applied to the bar 48 by the elements 50. As portions 22, 24 are meshed together under great pressure PP, the bar 48 is loaded (pressure at BB) via the pitch of elements 50. The bar 48 is also loaded (pressure at TT) by the lateral squeezing of ribs 32*b*, 32*c* and therefore the elements 50 toward bar 48 due to the pitch of sidewalls 32*d*' and 32*e*' acting in wedging concert with the corresponding pitch of sidewalls 32*b*' and 32*c*' as the pressure PP forces the portions 22, 24 toward one another. The pressures at both TT and BB are maximized when portions 22, 24 are completely meshed together. One of ordinary skill in the art can readily see that lateral loads and pressures TT and BB may be conveniently and easily regulated by the proper selection of the dimensions, location and pitch of ribs 32*b*, 32*c*, 32*d*, 32*e* and elements 50.

Figure 6:
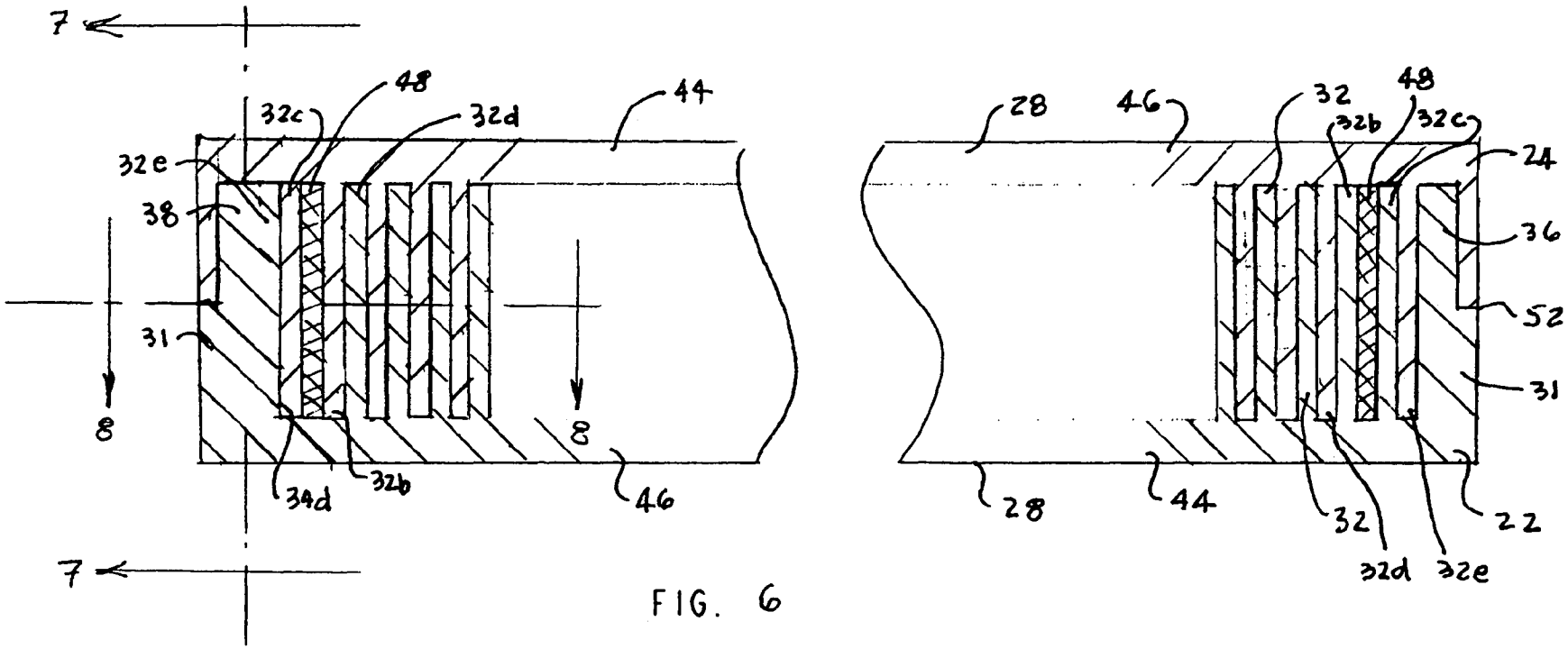
FIG. 6 is an enlarged, fragmentary cross-sectional view taken essentially along the line 6-6 of FIG. 1.
Figure 7:
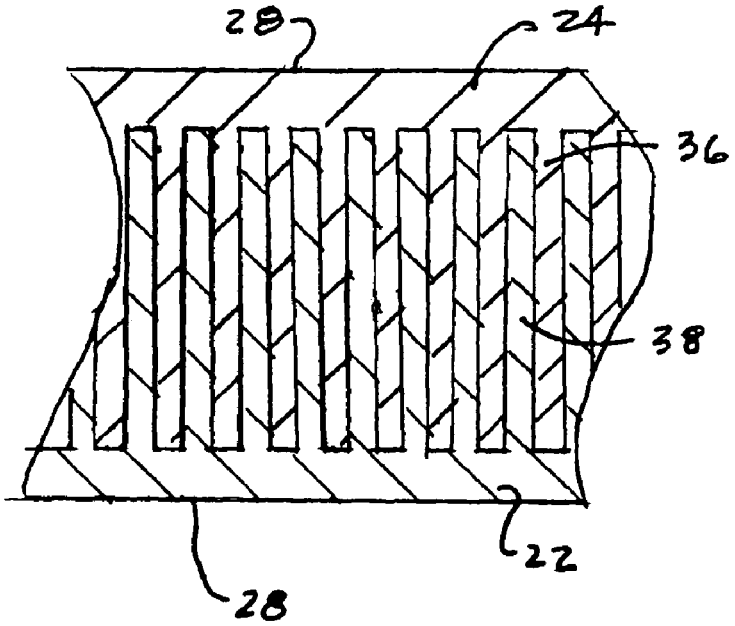
FIG. 7 is an enlarged, fragmentary cross-sectional view taken essentially along the line 7-7 of FIG. 6.
Figure 8:
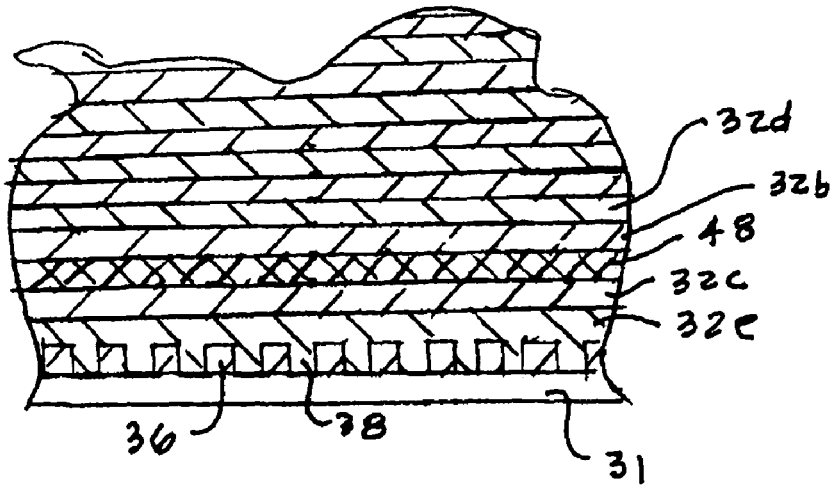
FIG. 8 is an enlarged, fragmentary cross-sectional view taken essentially along the line 8-8 of FIG. 6.

After the portions 22, 24 are joined together with the steel bars 48 in place, the panel 20 will be in the condition illustrated schematically and most particularly in FIGS. 6, 7 and 8, where it can be seen that the ribs of the segment 44 of portion 22 are disposed in intermeshing and mating relationship with the ribs of the segment 46 of portion 24, and the ribs of the segment 46 of portion 22 are disposed in intermeshing and mating relationship with the ribs of the segment 44 of portion 24. It is also believed to be of significance that the parting line 51 between the portions 22, 24 is positioned centrally of the peripheral edges of panel 20. While the latter is preferred it is not critical and simply is one result of the portions being identical. On the other hand, it has been determined in accordance with the invention, that a centrally disposed parting line 51 plays a highly significant role in preventing or at least minimizing separation and/or failure of the portions 22, 24 during use. The identicalness of the portions is also not critical insofar as the broader aspects of the invention are concerned and simply is a factor which enhances the efficiencies and economies of the panel 20.

As mentioned above, and as can particularly be seen in FIGS. 9 and 10, the sides 32*a*' of the ribs 32*a* desirably may have a slight pitch from top to bottom of the panel portion 22. In particular this slight pitch may preferably be about 1 degree, although by no means is the exact pitch critical to the invention, and in fact the pitch may need to be manipulated and/or varied so as to achieve optimum performance for various configurations and arrangements of ribs and the respective vibration/harmonic characteristics of the paving unit production equipment. The same pitch may also be applicable to all of the other ribs described above. Such pitch enhances the assembly and joinder of the portions 22, 24. Moreover, the pitch maximizes the surface areas in contact after assembly and thereby the friction resisting disassembly. In this regard it is within the contemplation of the invention to roughen or add miniscule barbs to the contact surfaces between the intermeshed ribs so as to enhance the frictional holding power brought into play. In connection with the foregoing, the contact surfaces may desirably be provided with molded clearances of approximately 0.003 inch and a vapor hone or light bead blast finish. With further reference to the pitch or draft of the rib sides, suffice it to say, and as would readily be recognized by those of ordinary skill in the plastic pallet art, if the draft angle is too large there will be insufficient friction between the contacting sides of adjacent ribs to hold the separate portions of the pallet together.

Again with reference to FIGS. 9 and 10, it can be seen that the ribs 32 have respective transverse cross-sectional configurations presenting a proximal end 100 disposed adjacent inner face 30 and a distal end 102 that is spaced form inner face 30. Desirably distal end 102 is arcuate and ideally the same is semi-circular in shape as shown. With further reference to FIG. 9, it can also be seen that the proximal ends 102 of adjacent ribs 32 define a hollow space 104 therebetween that is complementary in shape to said distal end. The described configuration facilitates molding of the panel portions. In this regard it is to be noted that the preferred method for molding parts such as the pallet portions contemplates injection of the molten molding material at the crests of the ribs so as to facilitate venting and prevent trapping of air in the ribs causing air bubbles and weak weld or knit lines. The rounded crests allow the molten plastic to fill the mold without excessive turbulent flow. In this regard it is to be noted that if the crests and valleys were truncated rather than rounded, sharp edges and corners would be present to cause turbulent flow which would create air pockets and the like. To avoid turbulence, the injection process would need to be slowed to an impractical level.

The rounded crests and valleys also improve the functionality of the pallet portions. As mentioned above, when boards such as the board 20 are used in the production of unitary concrete masonry products such as paving stones and the like, the board is exposed to the conditions of a variety of unit processes including molding, compacting, curing, etc. Vibration of the green products plays a significant role in these regards. When the crests and valleys of the ribs are truncated, there are a large number of sharp edges which often cause cracking during usage and particularly during vibration. In addition, such sharp edges are the cause of separation of the pallet portions when the pallets are exposed to vibrational forces. It has been found that when the crests and valleys are rounded so as to avoid sharp corners, the vibrational forces are rendered essentially harmless.

In accordance with the invention, and as detailed above, a plastic panel 20 is provided comprising first and second joinable portions 22, 24. The portions 22, 24 each may comprise a support backing 27 including a plurality of ribs. The ribs of a first grouping of ribs are disposed in general parallelism with one another and extend across a first area of a face of the support backing in a first direction, and the ribs of a second grouping of ribs extend across a second area of the face in a second direction which is not parallel with said first direction. This configuration with ribs extending in different directions prevents disassembly of the separate portions simply by rotating one of the panels around an axis which is perpendicular to the major axes of the ribs if the latter were all parallel. That is to say, the presence of the second grouping of transversely oriented ribs prevents such rotational disassembly and permits disassembly to occur only by moving the panel portions apart in a direction that is normal to the major plane of the panel while maintaining the same in generally parallel planes. All-in-all, the novel construction of the invention provides a panel that is relatively lightweight, sturdy, long-lasting, damage and wear resistant, dimensionally stable and rigid. Moreover, once joined, the separate portions of the panel resist disassembly and do not require the inclusion of screws or bolts or other fasteners for holding the panel portions together.

Stub ribs 36, 38 are an important feature of the preferred embodiment of the invention. As mentioned above, these stub ribs 36, 38 are aligned such that the same extend in a direction which is not parallel to the major axes of ribs 32. In fact, in the most preferred form of the invention, the stub ribs are arranged so as to run perpendicularly relative to ribs 32. If all of the ribs were to extend in the same direction, for example in parallelism to the major axis 33 of FIG. 3, there would be a rib at each side of each portion of the pallet. Thus, the seam line at these sides would ordinarily not be disposed at the center of the pallet edge. Rather, the seam lines would be close to the outer faces 27 in a position to present sharp edges whereupon snagging and resultant breakage would be commonplace. Rounding of the corners in an attempt to limit snagging thins the walls and only exacerbates the problem. In addition to the foregoing, if all of the ribs were to run in the same direction, the seam line at the ends of the ribs would ordinarily be at the center of the edge of the pallet. Hence, the seam line would need to be stepped at each corner. Such a configuration leads to sharp, damage prone, hard to mold pallet corners. When the stub ribs 36, 38 of the invention are employed, it is possible to position the parting or seam line at the centrally of each of the four edges of the pallet and to provide the latter with rounded corners. Such construction greatly reduces the potential for damage to the pallet.

If one were to force the issue of positioning the seam line centrally of the edges of the pallet even though all of the ribs run in the same direction, the result would be walls of varying thicknesses at the edges of the pallet portions. This would then violate plastic molding norms which dictate walls of uniform thicknesses. When wall thicknesses are not uniform, long molding cycles are required, often resulting in uncontrollable foaming during molding leading to weak spots, etc. If the thicker areas were to be hollowed out, weak and damage prone areas would be created.

In addition to the foregoing, when all of the ribs are parallel to the major axis of the pallet, the separate portions tend to part at the seam line when exposed to vibration. Testing has shown that it is difficult to prevent such separation even if separate hardware, such as screws or the like, is employed in an attempt to hold the portions together. When the stub ribs 36, 38 of the invention are employed, it is nearly impossible to separate the pallet portions even in the total absence of attachment means such as screws, glue and/or hot melt, etc. Moreover, the inclusion of the stub ribs 36, 38 facilitates the placement of the seam line centrally of the edges of the pallet. Additionally, the inclusion of the stub ribs 36, 38 facilitates the provision of rounded corners for the pallet. These features greatly reduce the potential for pallet damage during usage.

Figure 14:
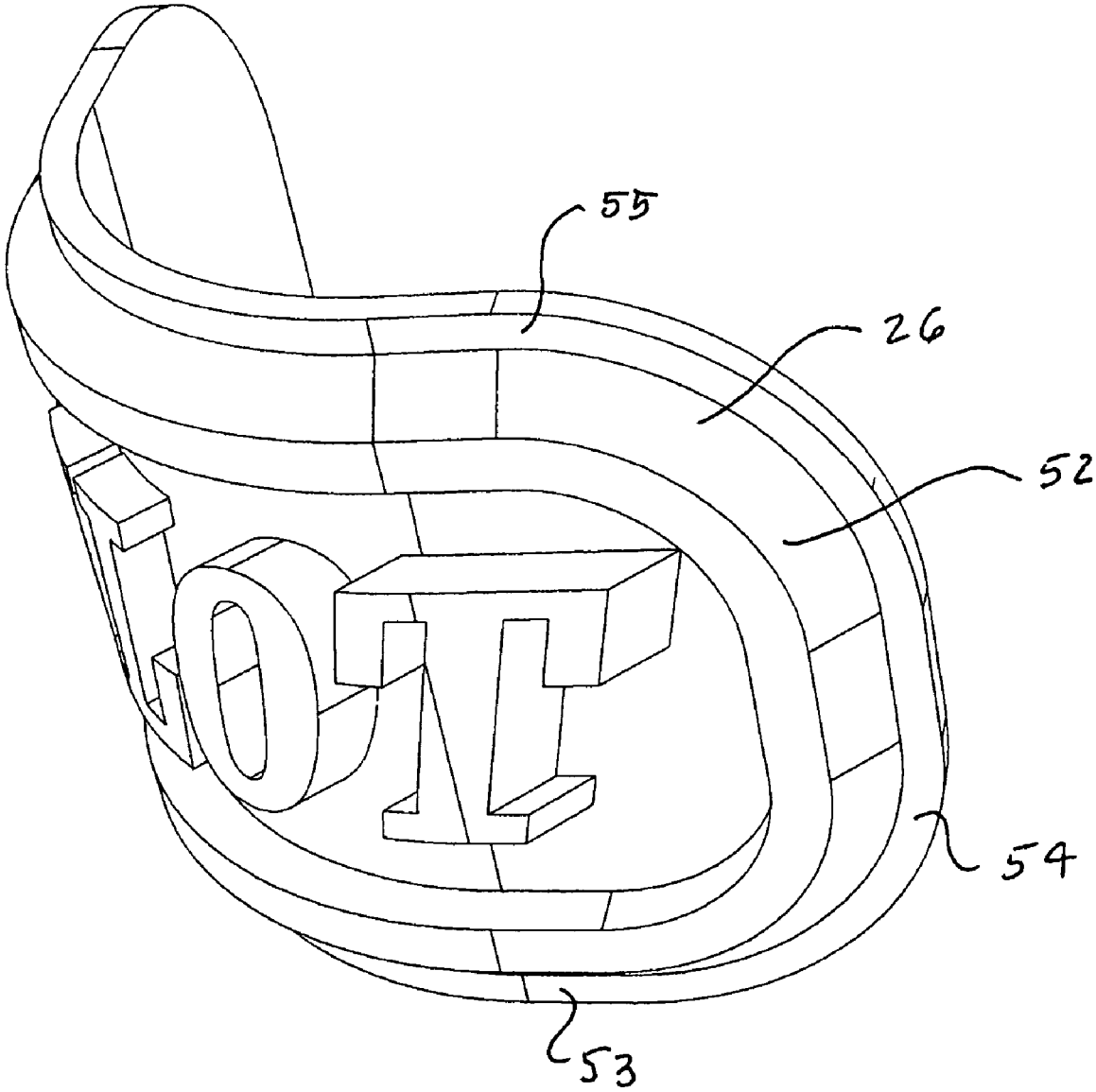
FIG. 14 is an enlarged isometric view of a corner bumper for the plastic panel of FIG. 1.

A corner bumper 26 which embodies the concepts and principles of the invention is shown in greater detail in FIG. 14, where it can be seen that the same comprises a curved main body segment 52 surrounded by an outwardly extending brim portion 54, which in the embodiment shown in FIG. 14 extends all of the way around bumper 26. And with reference to FIG. 2, it can be seen that each of the portions 22, 24 is provided with a hollowed out indentation 56 disposed in the corner 57 of the outer wall 31 thereof. These indentations 56 are aligned in such away that when the panel portions 22, 24 are joined together to form the panel 20, a single bumper receiving pocket 58 is presented (FIG. 15).

Figure 15:
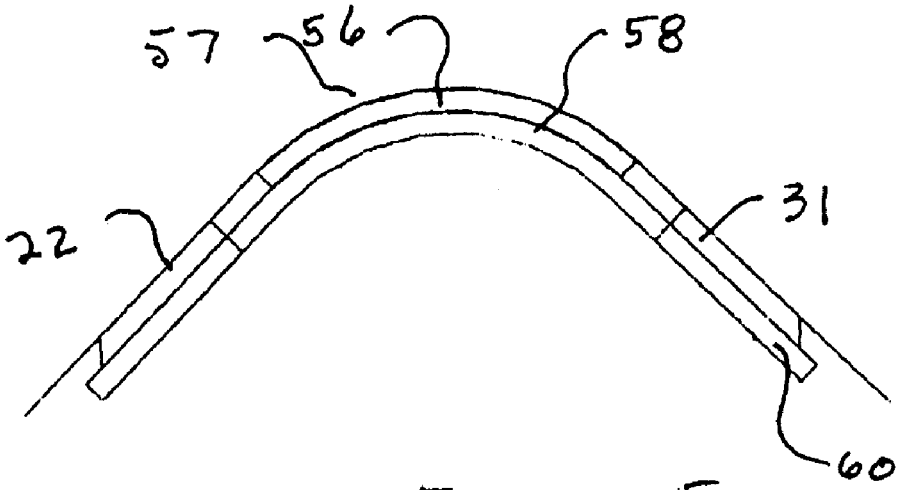
FIG. 15 is an enlarged top plan view of the corner of the outer wall of the plastic panel portion as illustrated in FIG. 4.

FIG. 15 is an upper plan view of the indentation 56 of portion 22 where it can be seen that the same includes an internal groove 60 having a configuration that is complementary to the configuration of lower segment 53 of brim portion 54 whereby the latter may become nestled in the groove 60 when the bumper 26 is in place in the indentation 56. During assembly of the panel 20, the bumper 26 is first positioned in the indentation 56 of the panel portion 22 with the lower segment 53 of brim portion 54 nestled in the groove 60 as can best be seen in FIG. 16. Then the upper panel portion 24 is moved straight downwardly from a position above the portion 22 so that the bumper 26 is received in the indentation 56 of panel portion 24 with the upper segment 55 of the brim portion 54 nestled within the groove 60 of indentation 56 of the panel portion 24.

Figure 16:
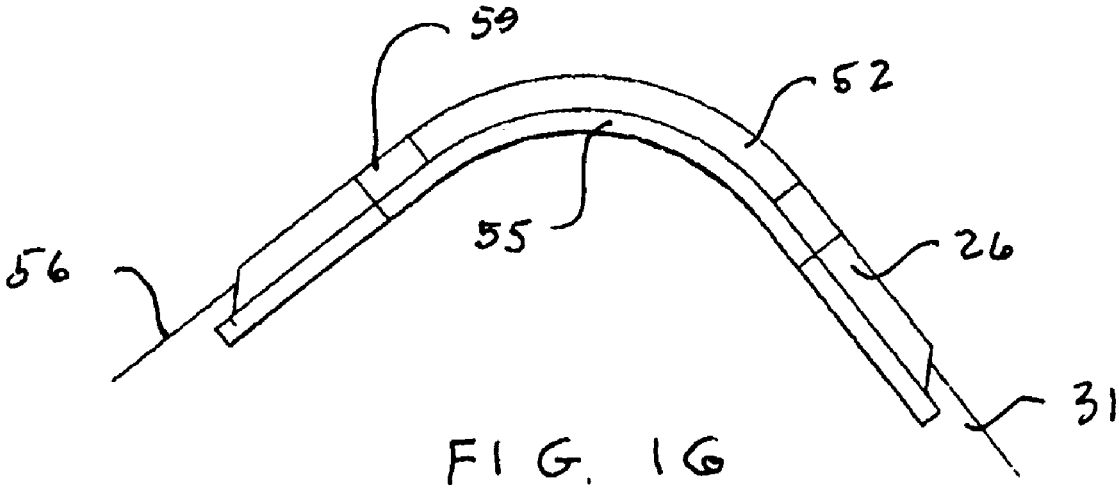
FIG. 16 is a view similar to FIG. 15 but with a corner bumper in place.

As can be seen with reference to FIG. 16, the corner bumper 26 may be configured in such a way that when installed within bumper receiving pocket 58, the main body segment 52 thereof has an outer portion 59 which protrudes slightly beyond the outer face 56 of the wall 31 to protect the corners of the panel 20 against wear and damage during use. The amount or degree of the protrusion is a function of a number of criteria and may need to be varied depending upon such things as the material from which the same is made. However, as a rule, the protruding portion 54 of the main body segment 52 may desirably have a thickness of about 0.125 inch.

Figure 18:
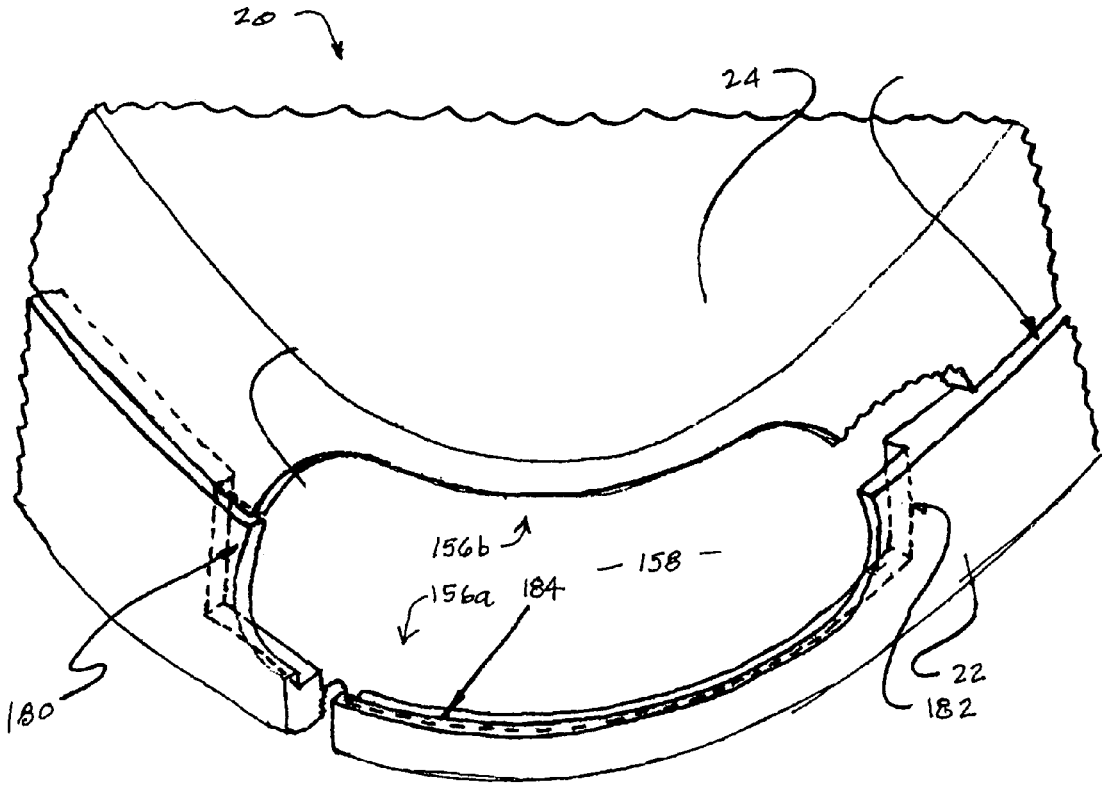
FIG. 18 is an enlarged schematic isometric exploded view illustrating a second embodiment of a corner bumper and the manner n which the same is inserted into a corner of a panel.
Figure 18:
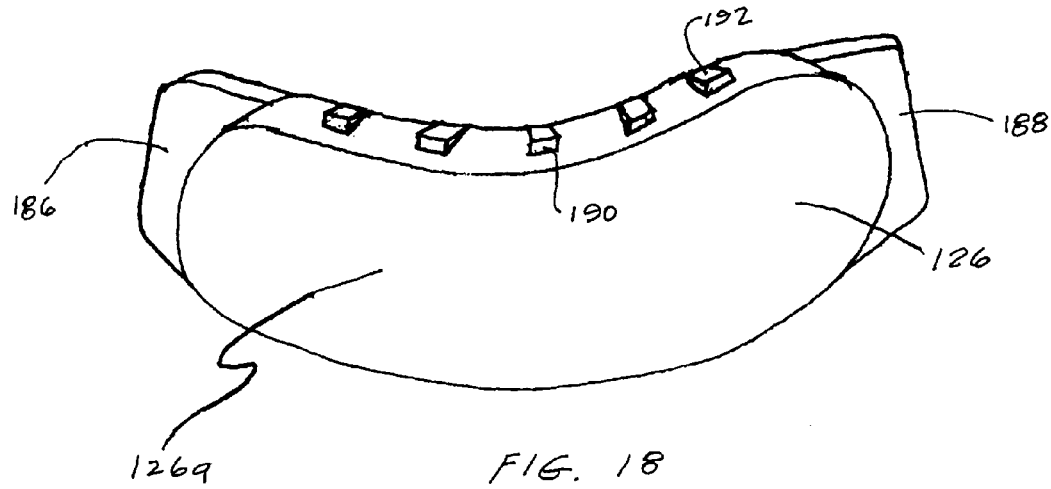

Another embodiment of a corner bumper embodying the concepts and principles of the invention is illustrated in FIG. 18 where it is identified by the reference numeral 126. In this case a hollowed out indentation 158 may be provided in the corner of the pallet 20 as shown when portions 22, 24 are joined together. For clarity, the bars and ribs of pallet 20 are not shown in this view. And again for clarity, the details of only the lower half 156*a* of the indentation 158 (in portion 22) are shown. However, it is to be understood that the upper half 156*b* of the indentation (in portion 24) is a mirror image of the lower half 156*a*. The lower half 156*a* includes a left hand flange receptacle pocket 180, a right hand flange receptacle pocket 182 and a barb retaining lip 184.

Bumper 126 has a left hand end flange 186 and a right hand end flange 188, and the same includes a series of preferably ramp shaped barbs 190, each having an inclined plane surface 192. In accordance with the concepts and principles of the invention, bumper 126 may be inserted after portions 22 and 24 are joined together. To do this, end flange 186 is slipped into receptacle pocket 180, and then bumper 126 is bent enough so that at least a portion of end flange 188 may be inserted into receptacle pocket 182. This bending of the bumper 126 may desirably be facilitated by constructing the same of a resilient plastic material. By then pushing inwardly on the outer face 126*a* of bumper 126, the barbs 190 snap into place behind the barb retaining lip 184. The inclined plane surfaces 192 facilitate the movement of the barbs 190 into a proper disposition relative to the lip 184. The configuration of the bumper 126 desirably is such that after installation, outer face 126*a* protrudes outwardly beyond the outer walls of the corners of portions 22, 24, whereby the bumper 126 is in a position to absorb impacts and the like which might otherwise damage the pallet.

We claim:

1. A plastic panel comprising first and second joinable portions, said portions each comprising:

a support backing including an outer surface and an inner face; and a plurality of ribs extending outwardly away from said inner face, wherein the ribs of a first grouping thereof are disposed to extend across a first area of the face in a first direction in general parallelism relative to one another, and wherein the ribs of a second grouping thereof are disposed to extend across a second area of the face in a second direction which is not parallel with said first direction, said portions being configured, disposed and arranged so as to join with one another in generally overlapping and mated relationship with said outer surfaces disposed in spaced apart opposing relationship, with the first grouping of ribs of the first portion disposed in intermeshing and mating relationship with the first grouping of ribs of the second portion, and with the second grouping of ribs of the first portion disposed in intermeshing and mating relationship with the second grouping of ribs of the second portion whereby to present said plastic panel, wherein each of said portions includes a peripheral wall which extends around the ribs, and wherein said walls have shoulders which are disposed in abutting relationship when the potions are joined together.

2. A plastic panel as set forth in claim 1, wherein the ribs of the second grouping are disposed at right angles relative to the ribs of the first grouping of each portion, wherein each portion includes two of said second groupings of ribs disposed on opposite sides of said first area of the face, and wherein said portions are identical.

3. A plastic panel as set forth in claim 2, wherein said portions each include at least one reinforcing bar gap which is parallel to the ribs of said first grouping, said gaps being configured, arranged and positioned for alignment to present a reinforcing bar holding slot when the portions are joined together, wherein said ribs have respective transverse cross-sectional configurations including a proximal end adjacent said inner face and a distal end spaced from said inner face, said distal end being arcuate, wherein said distal end is generally circular in shape, and wherein the proximal ends of adjacent ribs define a hollow space therebetween that is complementary in shape to said distal end.

4. A plastic panel comprising first and second joinable portions, said portions each comprising:

a support backing including an outer surface and an inner face; and a plurality of ribs extending outwardly away from said inner face, wherein the ribs of a first grouping thereof are disposed to extend across a first area of the face in a first direction in general parallelism relative to one another, and wherein the ribs of a second grouping thereof are disposed to extend across a second area of the face in a second direction which is not parallel with said first direction, said portions being configured, disposed and arranged so as to join with one another in generally overlapping and mated relationship with said outer surfaces disposed in spaced apart opposing relationship, with the first grouping of ribs of the first portion disposed in intermeshing and mating relationship with the first grouping of ribs of the second portion, and with the second grouping of ribs of the first portion disposed in intermeshing and mating relationship with the second grouping of ribs of the second portion whereby to present said plastic panel, wherein said ribs have respective transverse cross-sectional configurations including a proximal end adjacent said inner face and a distal end spaced from said inner face, said distal end being arcuate.

5. A plastic panel as set forth in claim 4, wherein said distal end is generally circular in shape.

6. A plastic panel as set forth in claim 4, wherein the proximal ends of adjacent ribs define a hollow space therebetween that is complementary in shape to said distal end.

* * * * *